United States Patent [19]

Mitchell

[11] 4,322,859

[45] Apr. 6, 1982

[54] SHOULDER PAD

[75] Inventor: Hal D. Mitchell, Rolla, Mo.

[73] Assignee: A-T-O Inc., Willoughby, Ohio

[21] Appl. No.: 143,900

[22] Filed: Apr. 25, 1980

[51] Int. Cl.[3] ..... A41D 13/00

[52] U.S. Cl. ..... 2/2

[58] Field of Search ..... 2/2 R, 2.7, 267, 268

[56] References Cited

U.S. PATENT DOCUMENTS

| | | | |
|---|---|---|---|
| 1,526,417 | 2/1925 | Goldsmith | 2/2.7 |
| 2,761,143 | 9/1956 | Martin et al. | 2/2.7 |
| 4,135,252 | 1/1979 | Latina et al. | 2/2.7 |
| 4,158,242 | 6/1979 | Mitchell | 2/2.7 |

*Primary Examiner*—Henry Jaudon

*Attorney, Agent, or Firm*—Senniger, Powers, Leavitt and Roedel

[57] ABSTRACT

A shoulder pad for football players comprising a left-hand member which fits over the left shoulder and a right-hand member which fits over the right shoulder. Each of the members is of generally inverted U-shape as viewed from the side and comprises a chestplate, a backplate and an arch at the top of the shoulder adjacent the neck of the wearer. The chestplate, backplate and arch each comprises a separate, discrete piece of relatively rigid material, the arch being mounted for upward swinging movement with respect to the chestplate and backplate whereby freedom is provided for raising the arms above a horizontal position by permitting upward movement of the arm at the shoulder without substantial interference from the arch.

12 Claims, 4 Drawing Figures

SHOULDER PAD

BACKGROUND OF THE INVENTION

This invention relates generally to athletic apparel, and more particularly to a shoulder pad for football players.

Shoulder pads as conventionally designed have been extremely bulky and cumbersome and have severely restricted the upper body movement of the athlete, particularly the upward movement of the arms and shoulders. Moreover, the manufacture of these shoulder pads has been relatively expensive, due in part to the fact that the pads comprise relatively large pieces of molded plastic. Reference may be made to coassigned U.S. Pat. Nos. 4,158,242 and 4,135,252 for shoulder pads generally in the field of this invention.

SUMMARY OF THE INVENTION

Among the several objects of this invention may be noted the provision of an improved shoulder pad which allows greater mobility of the upper body of the wearer, particularly the shoulders, so that the arms may be raised without undue interference from the shoulder pad; the provision of such a shoulder pad which is constructed for increased player mobility and reduced manufacturing costs; the provision of such a shoulder pad which provides added protection for the shoulders of the wearer; and the provision of such a shoulder pad which is compact and simple in design.

Generally, a shoulder pad of this invention comprises a left-hand member adapted to fit over the left shoulder and a right-hand member adapted to fit over the right shoulder, each of the members being of generally inverted U-shape as viewed from the side and comprising a chestplate, a backplate and an arch at the top of the shoulder adjacent the neck of the wearer. The arches are laterally spaced to provide an opening for the neck of the wearer with the spacing such that the arches lie adjacent and relatively close to the neck. The chestplate, backplate and arch each comprises a separate, discrete piece of relatively rigid material, the arch being mounted for upward swinging movement with respect to the chestplate and backplate whereby freedom is provided for raising the arms have a horizontal position by permitting upward movement of the arm at the shoulder without substantial interference from the arch.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
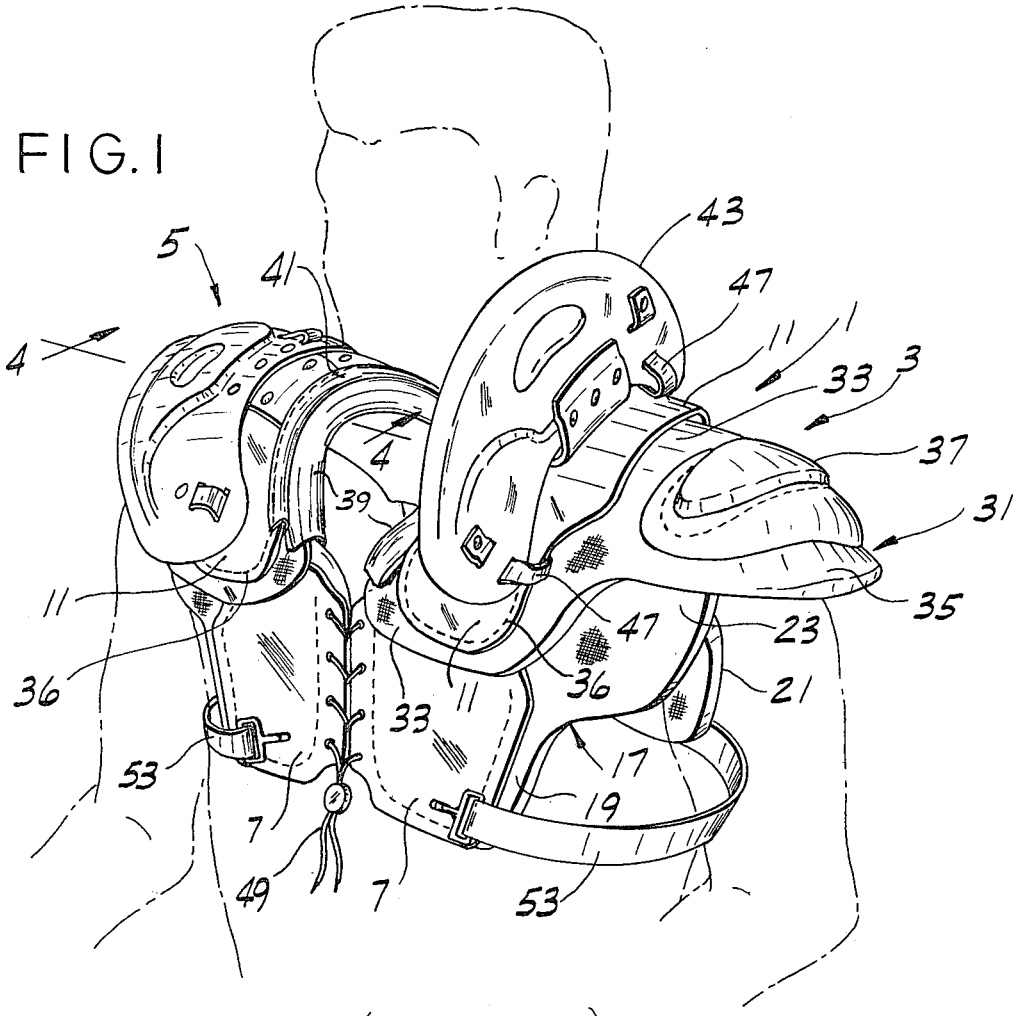
FIG. 1 is a perspective of a shoulder pad of the present invention being worn by a football player, a flap of the left-hand member of the shoulder pad being raised to illustrate details.

Referring to the drawings, a shoulder pad made according to the present invention is designated generally by the reference numeral 1 and is shown in FIG. 1 worn by a football player. It comprises a left-hand member generally indicated at 3 which fits over the left shoulder of the player and a right-hand member generally indicated at 5 which fits over the right shoulder. Each member is of a generally inverted U-shape as viewed from the side and comprises a chestplate 7, a backplate 9, and an arch 11 at the top of the shoulder adjacent the neck of the wearer. The arches 11 of the two members are laterally spaced to provide an opening for the neck of the wearer with a spacing such that the arches lie adjacent and relatively close to the neck and are generally arcuate in shape as viewed from the side so as to conform to the contour of the shoulder.

As shown, the chestplate 7, backplate 9 and arch 11 each comprises a separate, discrete piece of a suitable relatively lightweight molded plastic material, such as a high density polyethylene having a sufficiently high impact resistance to withstand the heavy blows received during the course of a football game. This multi-piece construction is, for several reasons, advantageous over conventional shoulder pads wherein the left and right-hand members comprise one-piece rigid plastic members. For example, since chestplate 7, backplate 9 and arch 11 comprise relatively small separate pieces, they may be formed by more economical molding processes, such as by injection molding, whereas the large one-piece rigid plastic members of conventional shoulder pads can generally be made only by compression molding. Moreover, the multi-piece construction permits greater freedom of movement of the wearer's arms as explained more fully hereinafter. A curved, relatively stiff member 13 extends along the underside of each arch and is affixed by rivets 15 at its ends to the arch (FIG. 4).

For added protection, each member 3, 5 further comprises body padding 17 which is of inverted U-shape as viewed from the side and which has chest, back and shoulder sections indicated at 19, 21 and 23, respectively. This padding preferably comprises a suitable closed cell elastomeric vinyl foam in a stretch fabric cover. Chestplate 7 is secured (e.g., stitched) to the chest section 19 of the body padding and backplate 9 is similarly secured to the back section 21 of the body padding. The chestplate 7, backplate 9, and the chest and back sections 19, 21 of the body padding protect the body of the wearer, more particularly the sternum, the ribs, the rib cartilages, and the musculature along the midline of the back of the wearer. The shoulder section of the body padding protects the inner and outer parts of the shoulder, including the clavicle, the pectoral muscles at their point of attachment to the humerous bone, the lateral aspects of the scapula, and the muscles attaching the scapula to the humerous bone.

Figure 2:
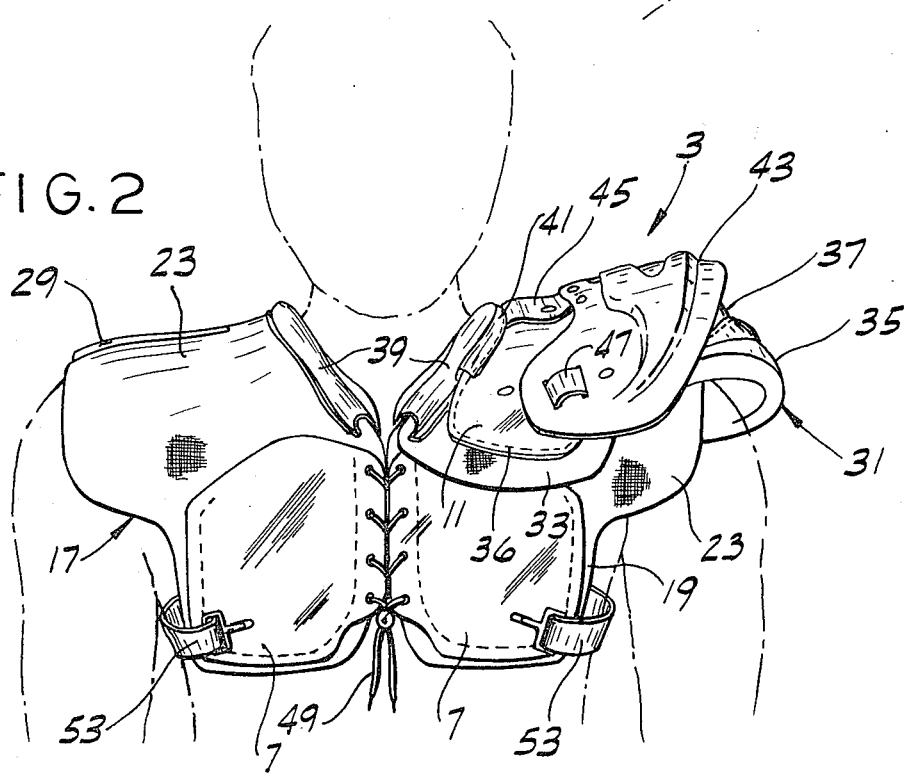
FIG. 2 is a front elevation of FIG. 1 with the flap and the arch of the right-hand member removed.
Figure 3:
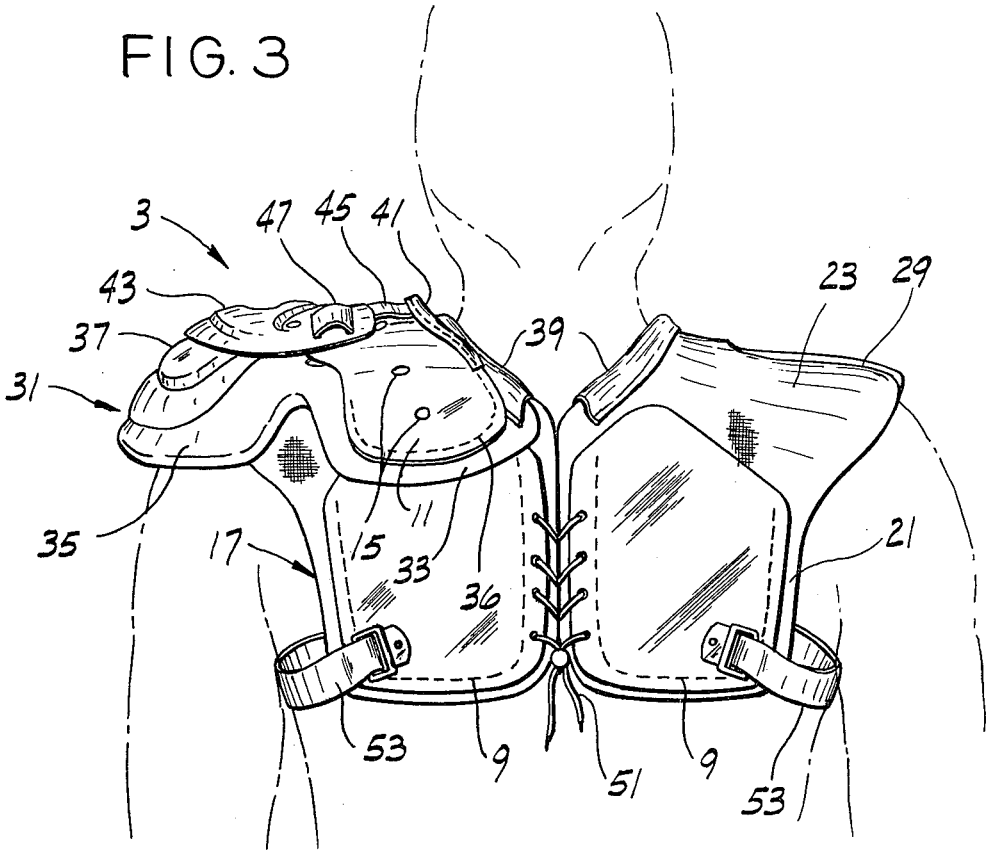
FIG. 3 is a rear elevation of FIG. 2.
Figure 4:
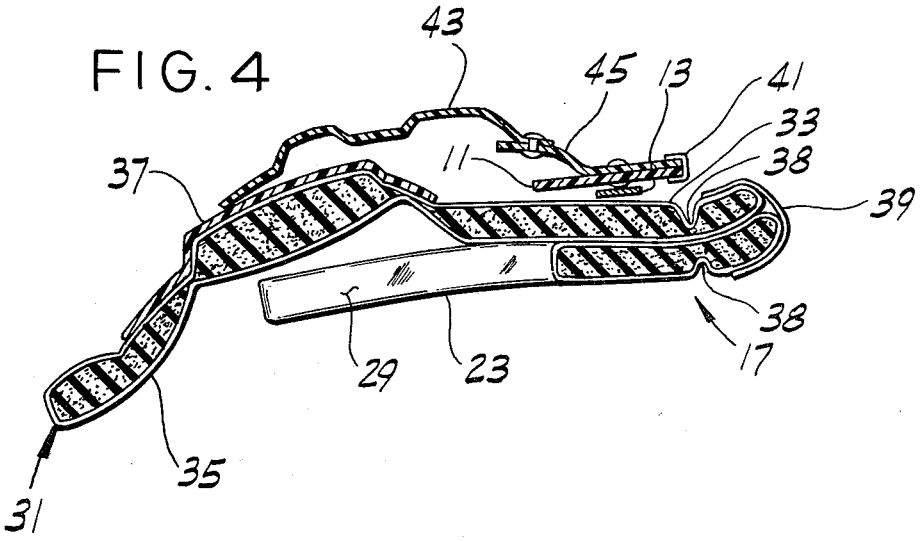
FIG. 4 is an enlarged vertical section on line 4—4 of FIG. 1.

As best shown in FIGS. 2 and 4, the shoulder section 23 of the body padding extends from a position adjacent the neck laterally outwardly over the shoulder to the outer part of the shoulder. For increased flexibility, a notch or slot 29 extends laterally inwardly from the outer edge of the section 23 at the top of the shoulder. This permits the padding at opposite sides of the notch to spread apart on upward movement of the arm at the shoulder, as when the arms are raised, thereby providing greater freedom of movement of the upper body.

In accordance with this invention, the arch 11 of each member 3, 5 is carried by shoulder padding generally indicated at 31 which overlies shoulder section 23 of the body padding. This shoulder padding 31 has inner and outer sections designated 33 and 35, respectively. The inner section 33 overlies the body padding at the inner part of the shoulder and extends from a point below the top of the chestplate 7 over the shoulder to a point below the top of the backplate, and the outer section 35 overlies the body padding (and notch 29) at the outer part of the shoulder. As indicated at 36, the arch 11 is attached (by stitching, for example) at its ends to the upper surface of the inner section 33 of the shoulder padding. A cap 37, generally convex in shape and preferably made of the same molded plastic as the chestplate, backplate and arch, is stitched or otherwise suitably secured on the outside of the outer section 35 of the shoulder padding to protect the outer part of the shoulder which is particularly injury-prone. As shown, the shoulder padding 31 is hinged along a line of stitching 38 to the shoulder section 23 of body padding 17 adjacent the inner edge of the latter (the right edge as viewed in FIG. 4), the line of stitching thus constituting a hinge line extending in front to back direction with respect to the shoulder pad over the shoulder. The hinged connection of the shoulder padding to the body padding is advantageous in that it enables shoulder padding 31 and the arch 11 and cap 37 thereon to swing upwardly with respect to the chestplate 7 and backplate 9. Thus freedom is provided for raising the arms above a horizontal position by permitting upward movement of the arm at the shoulder without substantial interference from the shoulder padding, arch and cap.

As shown best in FIG. 4, the inner edges of shoulder padding 31 and body padding 17 are positioned laterally inwardly from arch 11 relatively close to the neck. To ensure adequate protection for the neck, welted neck padding 39 is provided along these edges. Moreover, a trim strip 41 is folded and secured around the inner edge of arch 11.

A relatively rigid flap 43 of molded plastic overlies each cap 37 and is hinged to a respective arch 11 via a main hinge strap 45, the inner edge of which is covered by trim strip 39. As indicated at 47, two snubber straps connect the flap to the arch 11 at the front and back of the flap for restricting movement of the flap relative to the arch. The members 3, 5 are adjustably secured together at their chestplates 7 and backplates 9 by laces 49, 51, respectively. Adjustable elastic body straps 53 interconnect the chestplates and the backplates and are worn under the arms of the wearer to prevent displacement of the shoulder 1 upwardly and for otherwise keeping the shoulder pad properly positioned on the athlete.

It will be observed from the above that the improved shoulder pad 1 of this invention allows freedom of movement of the upper body, particularly the shoulders, so that the arms may be moved above a horizontal position without substantial interference from the shoulder pad. Moreover, the shoulder pad 1 provides a level of protection for the upper body of the wearer adequate even for linemen who receive numerous heavy blows throughout the course of a game. Another advantage of the pad is that members 3, 5 are of multi-piece construction, comprising relatively small discrete pieces of rigid plastic rather than large integrally formed members. This enables the shoulder pad 1 to be made more economically than conventional shoulder pads.

In view of the above, it will be seen that the several objects of the invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad for football players comprising a left-hand member adapted to fit over the left shoulder and a right-hand member adapted to fit over the right shoulder, each of said members being of generally inverted U-shape as viewed from the side and comprising a chestplate, a backplate and an arch at the top of the shoulder adjacent the neck of the wearer, said arches being laterally spaced to provide an opening for the neck of the wearer with the spacing such that said arches lie adjacent and relatively close to the neck, said chestplate, backplate and arch each comprising a separate discrete piece of relatively rigid material, said arch being mounted for upward swinging movement with respect to the chestplate and backplate about a hinge line extending in front to back direction with respect to the shoulder pad over the shoulder, whereby freedom is provided for raising the arms above a horizontal position by permitting upward movement of the arm at the shoulder without substantial interference from the arch.

2. A shoulder pad as set forth in claim 1 wherein each of said members further comprises body padding of generally inverted U-shape as viewed from the side and comprising chest, back and shoulder sections, said chestplate being secured to the outside of the chest section and said backplate being secured to the outside of the back section, and shoulder padding overlying said shoulder section of the body padding and carrying said arch on the outside thereof, said shoulder padding being attached to said body padding along said hinge line.

3. A shoulder pad as set forth in claim 1 wherein the arch is generally arcuate in shape as viewed from the side so as to conform to the contour of the shoulder.

4. A shoulder pad as set forth in claim 1 wherein each of said members further comprises body padding of generally inverted U-shape as viewed from the side and comprising chest, back and shoulder sections, said chestplate being secured to the outside of the chest section and said backplate being secured to the outside of the back section, and shoulder padding overlying said shoulder section of the body padding and the backplate and chestplate, and carrying said arch on the outside thereof, the shoulder padding extending from a point below the top of the chestplate over the shoulder to a point below the top of the backplate.

5. A shoulder pad as set forth in claim 1 wherein said chestplate, backplate and arch of each member are each of one-piece molded plastic construction.

6. A shoulder pad for football players comprising a left-hand member adapted to fit over the left shoulder and a right-hand member adapted to fit over the right shoulder, each of said members being of generally inverted U-shape as viewed from the side and comprising a chestplate, a backplate and an arch at the top of the shoulder adjacent the neck of the wearer, said arches being laterally spaced to provide an opening for the neck of the wearer with the spacing such that said arches lie adjacent and relatively close to the neck, said chestplate, backplate and arch each comprising a separate discrete piece of relatively rigid material, said arch being mounted for upward swinging movement with respect to the chestplate and backplate, each of said members further comprising body padding of generally inverted U-shape as viewed from the side and comprising chest, back and shoulder sections, said chestplate being secured to the outside of the chest section and said backplate being secured to the outside of the back section, and shoulder padding overlying said shoulder section of the body padding and carrying said arch on the outside thereof, said shoulder padding being hinged to the body padding adjacent the neck of the wearer for enabling it and the arch to swing upwardly with respect to the body padding on said upward movement of the shoulders, whereby freedom is provided for raising the arms above a horizontal position by permitting upward movement of the arm at the shoulder without substantial interference from the arch.

7. A shoulder pad as set forth in claim 6 wherein the shoulder padding comprises an inner portion adapted to overlie said body padding at the inner part of the shoulder and an outer portion adapted to overlie said body padding at the outer part of the shoulder, the arch being mounted on said inner portion, said shoulder pad further comprising a cap mounted on the outside of the outer portion of the shoulder padding adapted to fit over the outer part of the shoulder.

8. A shoulder pad as set forth in claim 7 wherein said inner portion of the shoulder padding extends from a point adjacent the top of the chestplate over the shoulder to a point adjacent the top of the backplate.

9. A shoulder pad as set forth in claim 6 wherein the inner edge of said body padding at the top of a respective shoulder is spaced inwardly of said arch, the shoulder padding being hinged to the body padding adjacent its inner edge.

10. A shoulder pad as set forth in claim 9 further comprising welted neck padding along the inner edges of said body and shoulder padding adjacent the opening for the neck of the wearer.

11. A shoulder pad as set forth in claim 6 wherein said shoulder section of said body padding extends from a position adjacent the neck of the wearer laterally outwardly over the outer part of the shoulder, said shoulder section having a notch therein extending laterally inwardly from the outer edge thereof at the top of the shoulder.

12. A shoulder pad as set forth in claim 11 wherein said shoulder padding overlies said notch in said body padding.

* * * * *